US010069241B2

(12) United States Patent
Hayasaka

(10) Patent No.: US 10,069,241 B2
(45) Date of Patent: Sep. 4, 2018

(54) FITTING CONNECTOR

(71) Applicant: Yazaki Corporation, Tokyo (JP)

(72) Inventor: Noboru Hayasaka, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/890,227

(22) Filed: Feb. 6, 2018

(65) Prior Publication Data

US 2018/0226748 A1 Aug. 9, 2018

(30) Foreign Application Priority Data

Feb. 6, 2017 (JP) ..... 2017-019947

(51) Int. Cl.
*H01R 13/627* (2006.01)
*H01R 13/641* (2006.01)

(52) U.S. Cl.
CPC ..... *H01R 13/6273* (2013.01); *H01R 13/6272* (2013.01); *H01R 13/641* (2013.01)

(58) Field of Classification Search
CPC ..... H01R 13/6273; H01R 13/6272; H01R 13/641
See application file for complete search history.

(56) References Cited

U.S. PATENT DOCUMENTS 9,425,549 B2 * 8/2016 Sekino ..... H01R 13/6272
9,653,846 B1 * 5/2017 Caldwell ..... H01R 13/62955
9,666,989 B2 * 5/2017 Horiuchi ..... H01R 13/64
9,742,115 B2 * 8/2017 Matsumoto ..... H01R 13/6272
9,923,297 B2 * 3/2018 Sekino ..... H01R 13/627
2002/0168896 A1 * 11/2002 Suzuki ..... H01R 13/4365 439/595
2011/0008988 A1 * 1/2011 Urano ..... H01R 13/6272 439/350
2013/0210266 A1 8/2013 Osada et al.
2017/0338587 A1 * 11/2017 Takeshita ..... H01R 13/5219
2017/0338600 A1 * 11/2017 Tanaka ..... H01R 13/6582

FOREIGN PATENT DOCUMENTS

JP 5653150 B2 1/2015

* cited by examiner

*Primary Examiner* — Briggitte R Hammond
(74) *Attorney, Agent, or Firm* — Kenealy Vaidya LLP

(57) ABSTRACT

A fitting connector includes: a first connector; a second connector; a detection member that is relatively movable to a main locking position with respect to a housing when the housings are completely fitted to each other and is locked to the housing at the main locking position; and first and second holding structures which keep the completely fitted state, in which the first holding structure includes a first locking holder for the housing with a locking portion and a second locking holder provided in the counterpart housing and entering the locking portion to regulate the relative movement between the housings in the completely fitted state, in which the second locking holder includes a protrusion portion entering the locking portion and a flexible portion capable of moving the protrusion portion in a direction opposite to the insertion direction toward the locking portion while being bent.

4 Claims, 13 Drawing Sheets

FITTING CONNECTOR

CROSS-REFERENCE TO RELATED APPLICATION(S)

The present application claims priority to and incorporates by reference the entire contents of Japanese Patent Application No. 2017-019947 filed in Japan on Feb. 6, 2017.

BACKGROUND OF THE INVENTION

1. Field of the Invention

The present invention relates to a fitting connector.

2. Description of the Related Art

Conventionally, there has been known a fitting connector including two connectors such as a female connector and a male connector to be fitted to each other and electrically connecting both terminals when the two connectors are fitted to each other. In the fitting connectors, a holding structure is provided between housings thereof to keep a fitted state between the housings of the connectors in a completely fitted state. The holding structure is used to keep the housings in the completely fitted state by engaging locking and holding portions respectively provided in the housings. For example, as the holding structure, a lock structure in which a claw portion or the like is locked to a counterpart member is used. This kind of fitting connector is disclosed in, for example, Japanese Patent No. 5653150.

Incidentally, a holding force required for the holding structure is different in response to the use environment or the like of the fitting connector. For example, when the holding force is increased to keep the completely fitted state, the locking and holding portions of the holding structure are increased in size or the number of the holding structure arrangement positions is increased. However, the fitting connector has concern that the workability at the time of inserting and extracting the connectors (the workability at the time of fitting the connectors or the workability at the time of releasing the fitted state between the connectors) may degrade in accordance with an increase in holding force. Further, the holding force needs to be kept.

SUMMARY OF THE INVENTION

An object of the invention is to provide a fitting connector capable of increasing a holding force for keeping a completely fitted state and keeping the holding force while preventing degradation in workability at the time of inserting and extracting a connector.

In order to achieve the above mentioned object, a fitting connector according to one aspect of the present invention includes a first connector that includes a terminal and a housing holding the terminal; a second connector that includes a counterpart terminal and a counterpart housing holding the counterpart terminal, the counterpart terminal being electrically connected to the terminal when a mutual fitted state in accordance with an insertion between the counterpart housing and the housing is in a completely fitted state; a detection member that is a member for detecting the fitted state, is relatively movable to a main locking position with respect to the housing when the fitted state is in the completely fitted state, and is locked to the housing at the main locking position; and a first holding structure and a second holding structure that keep the fitted state in the completely fitted state, wherein the first holding structure includes a first locking holder that is provided in the housing and includes a locking portion formed by a hole portion or a groove portion and a second locking holder that is provided in the counterpart housing and enters the locking portion of the first locking holder when the fitted state is in the completely fitted state to regulate a relative movement between the housing and the counterpart housing in a connector extraction direction, the second locking holder includes a protrusion portion that enters the locking portion of the first locking holder and a flexible portion that has flexibility and is capable of moving the protrusion portion in a direction opposite to a direction in which the first locking holder is inserted into the locking portion while the flexible portion being bent, and the detection member includes a bending locking portion that locks the bending of the flexible portion within a range in which the protrusion portion does not come out from the locking portion of the first locking holder at the main locking position.

According to another aspect of the present invention, in the fitting connector, it is desirable that the first holding structure is a slide locking structure in which the first locking holder and the second locking holder relatively move in accordance with the insertion between the housing and the counterpart housing and the protrusion portion of the second locking holder enters the locking portion of the first locking holder when the fitted state becomes the completely fitted state.

According to still another aspect of the present invention, in the fitting connector, it is desirable that the detection member is attached to the housing to be relatively movable with respect to the housing from a retracted position in which the bending of the flexible portion is not locked to the main locking position.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
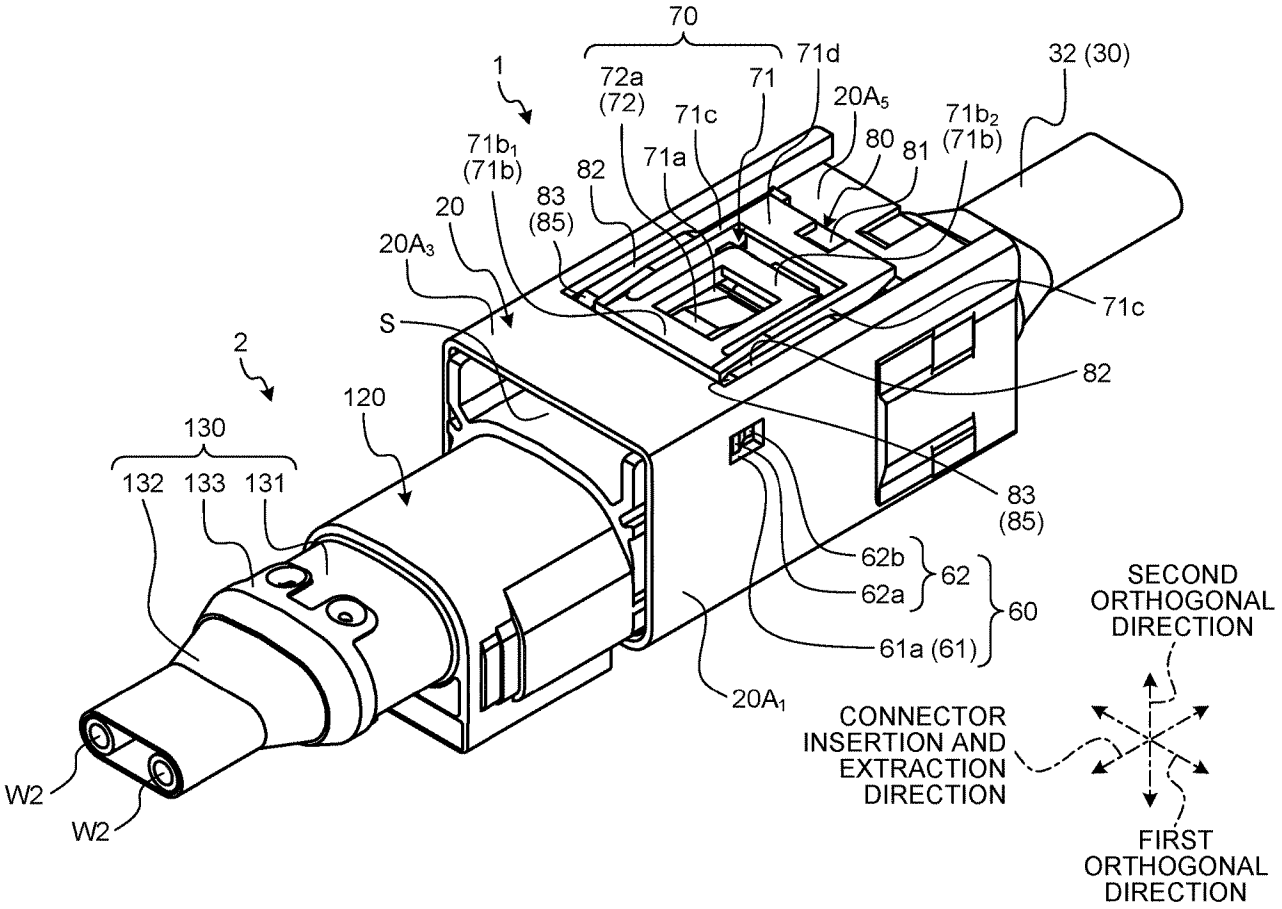
FIG. 1 is a perspective view illustrating a state where first and second connectors of an embodiment are completely fitted to each other and a detection member is located at a main locking position.

Hereinafter, an embodiment of a fitting connector according to the invention will be described in detail with reference to the drawings. Additionally, the invention is not limited to the embodiment.

Embodiment

A fitting connector is provided with two connectors (a first connector and a second connector) which are fitted to each other. In the fitting connector, the first connector and the second connector are fitted to each other by a mutual insertion operation and both terminals are fitted to each other along with the fitting so that the terminals are physically and electrically connected to each other. Meanwhile, in the fitting connector, the first connector and the second connector are separated from each other by a mutual extraction operation and the physical and electrical connection between both terminals is released along with this operation. The insertion direction (the fitting direction) and the extraction direction are opposite directions. In the description below, the insertion direction will be referred to as a "connector insertion direction", the fitting direction will be referred to as a "connector fitting direction", and the extraction direction will be referred to as a "connector extraction direction". Each of these directions indicates a direction with respect to its counterpart connector. Further, if these bidirectional orientations are not specified, the direction will be referred to as a "connector insertion and extraction direction". Further, a direction relative to or orthogonal to the connector insertion and extraction direction will be referred to as a "first orthogonal direction" and a direction orthogonal to the connector insertion and extraction direction and the first orthogonal direction will be referred to as a "second orthogonal direction".

Further, the fitting connector includes a detection member that determines the fitted state between the first connector and the second connector (hereinafter, referred to as the "connectors"). The detection member is used to determine whether the connectors are completely fitted to each other or half fitted to each other and detects the fitted state of the housings of the first connector and the second connector. The completely fitted state indicates a state where the housings of the first connector and the second connector are completely inserted to designed positions so that both terminals are physically and electrically connected to each other. The half fitted state indicates a state where the housings of the first connector and the second connector are being fitted to each other and a state other than the completely fitted state. For example, the half fitted state indicates the fitted state before the completely fitted state during an operation of fitting the connectors to each other or the fitted state after the completely fitted state is released during an operation of extracting the connectors. The fitting connector includes first and second holding structures which respectively keep the fitted states of the housings of the first connector and the second connector in the completely fitted state.

Hereinafter, a detailed example of each configuration of the fitting connector of the embodiment will be described with reference to FIGS. 1 to 13.

Reference Numerals 1 and 2 of FIGS. 1 to 6 respectively indicate the first connector and the second connector of the fitting connector of the embodiment. The fitting connector of the embodiment is a female/male connector including a female connector and a male connector, where the first connector 1 will be described as the female connector and the second connector 2 will be described as the male connector.

Figure 7:
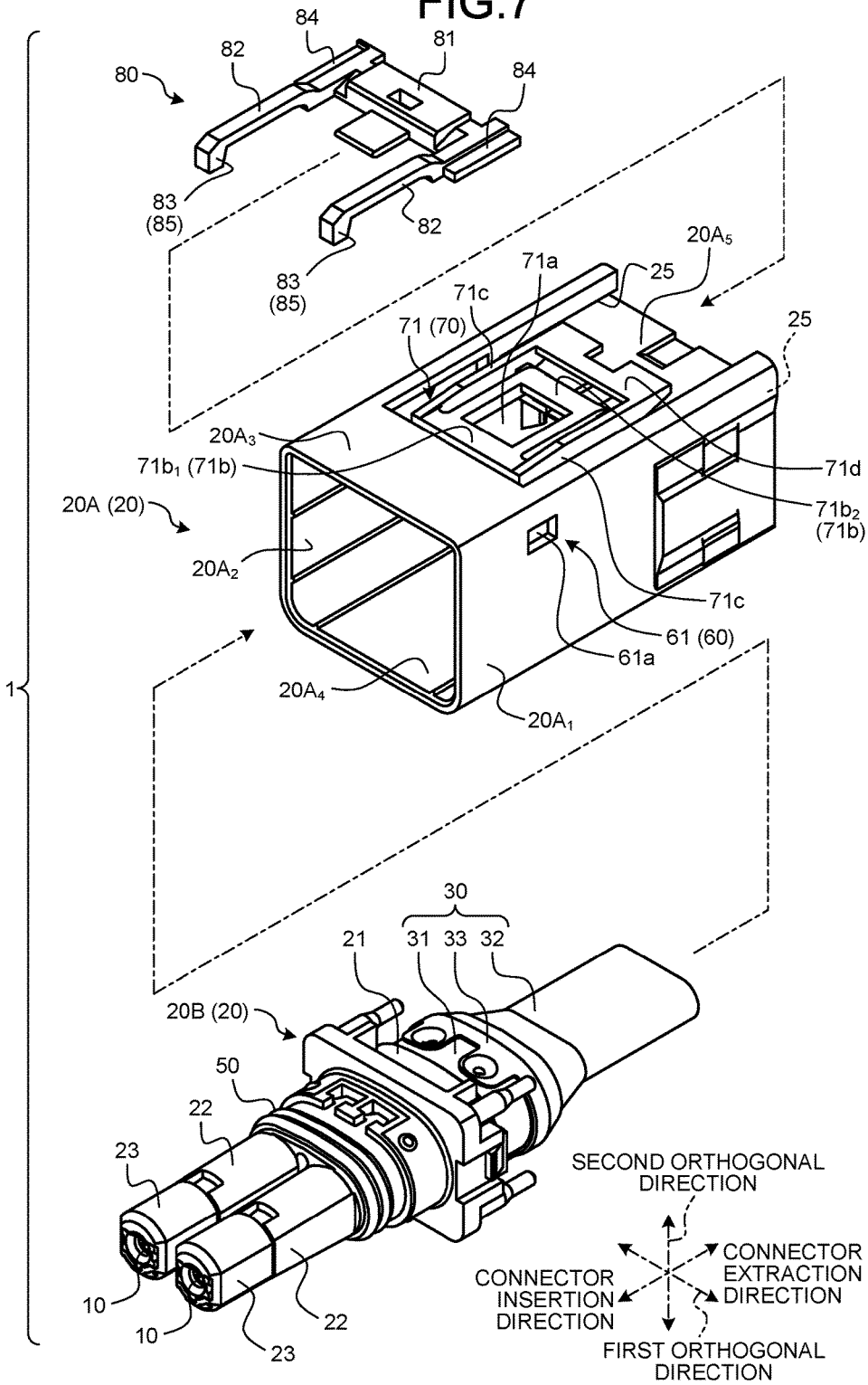
FIG. 7 is an exploded perspective view of the first connector of the embodiment.
Figure 8:
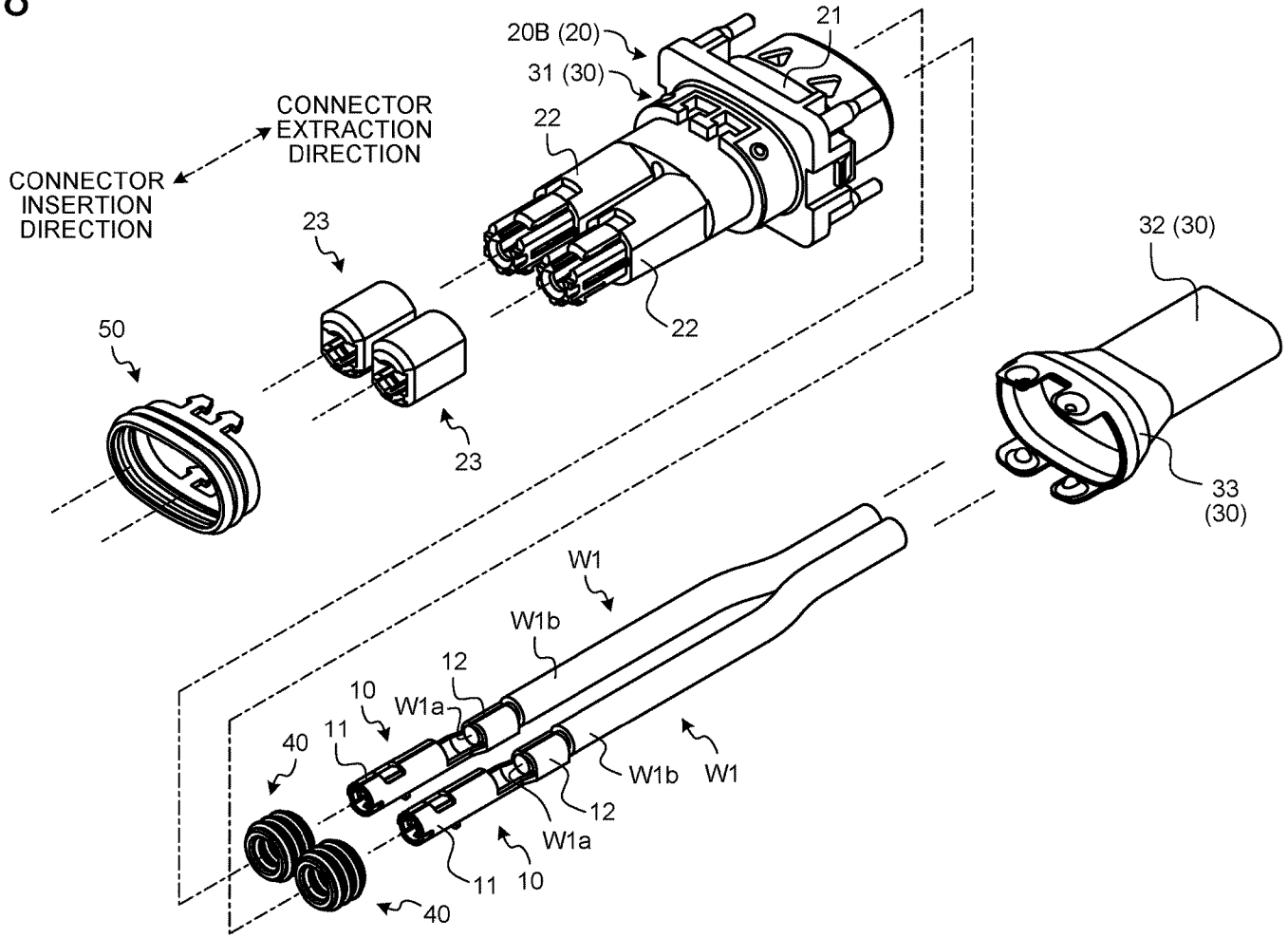
FIG. 8 is an exploded perspective view of an inner component of the first connector of the embodiment.
Figure 9:
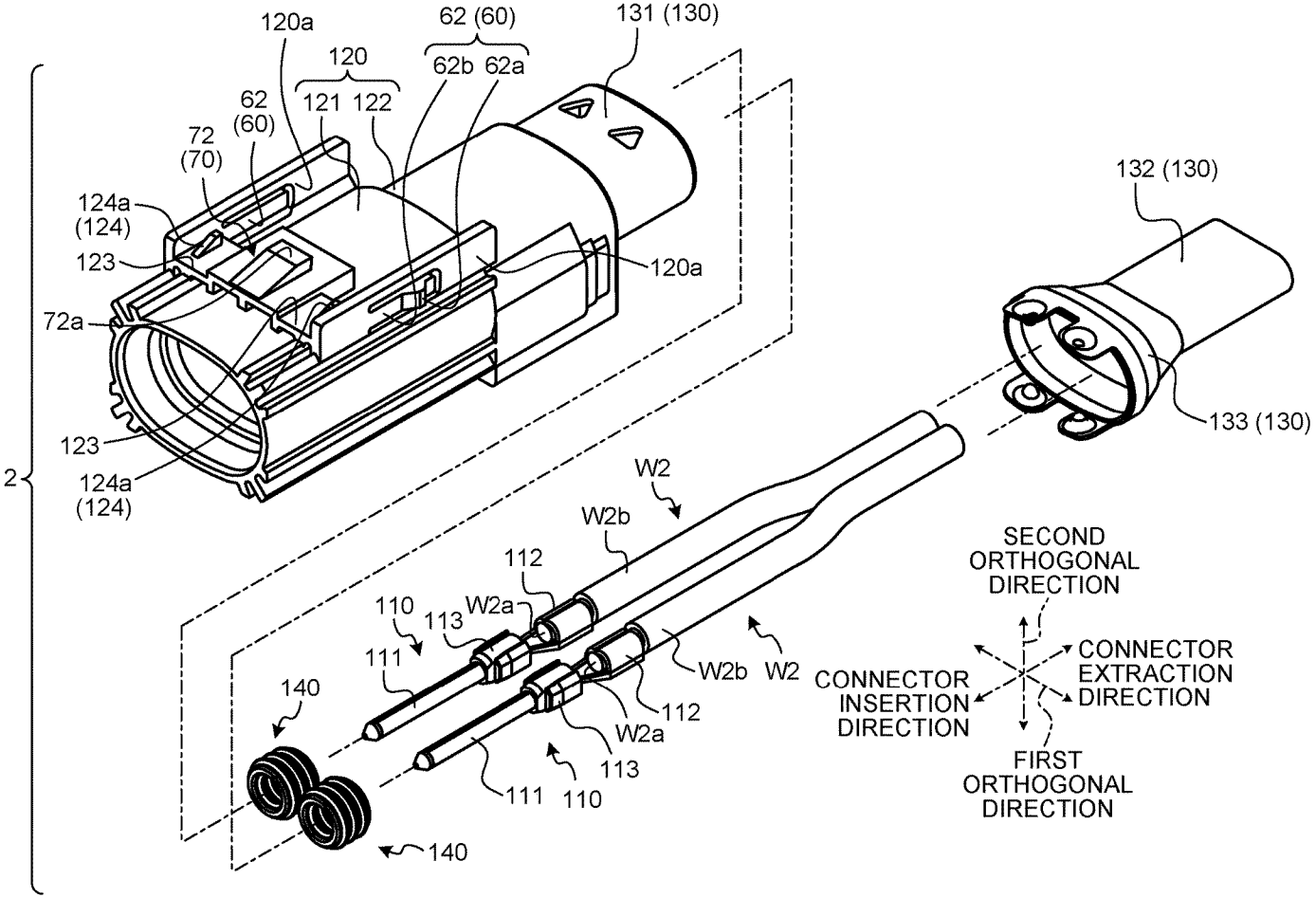
FIG. 9 is an exploded perspective view of the second connector of the embodiment.

The first connector 1 includes a terminal (hereinafter, referred to as a "female terminal") 10 and a housing (hereinafter, referred to as a "female housing") 20 holding the female terminal 10 (FIGS. 7 and 8). Further, the first connector 1 includes a shield structure 30 which prevents the intrusion of noise from the outside and a seal member 40 that prevents the intrusion of a liquid from the outside (FIGS. 7 and 8). The second connector 2 is a counterpart connector which is fitted to the first connector 1 and includes a counterpart terminal (hereinafter, referred to as a "male terminal") 110, a counterpart housing (hereinafter, referred to as a "male housing") 120 which holds the male terminal 110, a shield structure 130 which prevents the intrusion of noise from the outside, and a seal member 140 which prevents the intrusion of a liquid from the outside (FIG. 9). In the fitting connector, the female terminal 10 and the male terminal 110 are electrically connected to each other when the mutual fitted state between the female housing 20 and the male housing 120 in accordance with the insertion is the completely fitted state. In this example, the male housing 120 is inserted into the female housing 20. Further, in this example, a combination of the female terminal 10 and the male terminal 110 which are physically and electrically connected to each other is provided as two sets and the female terminal 10 and the male terminal 110 are arranged side by side in the same direction.

Figure 2:
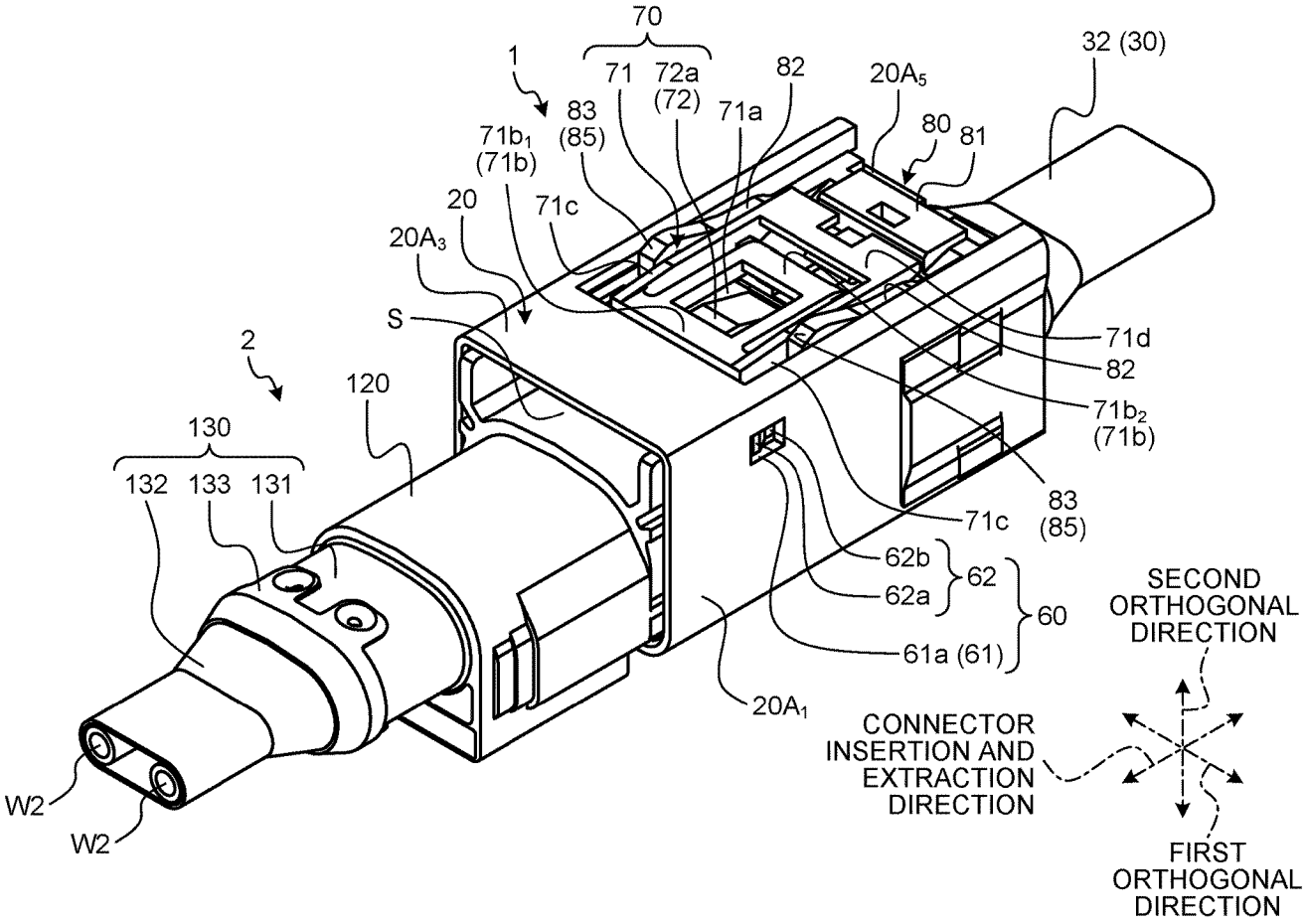
FIG. 2 is a perspective view illustrating a state where the first and second connectors of the embodiment are completely fitted to each other and the detection member is located at a temporary locking position.
Figure 3:
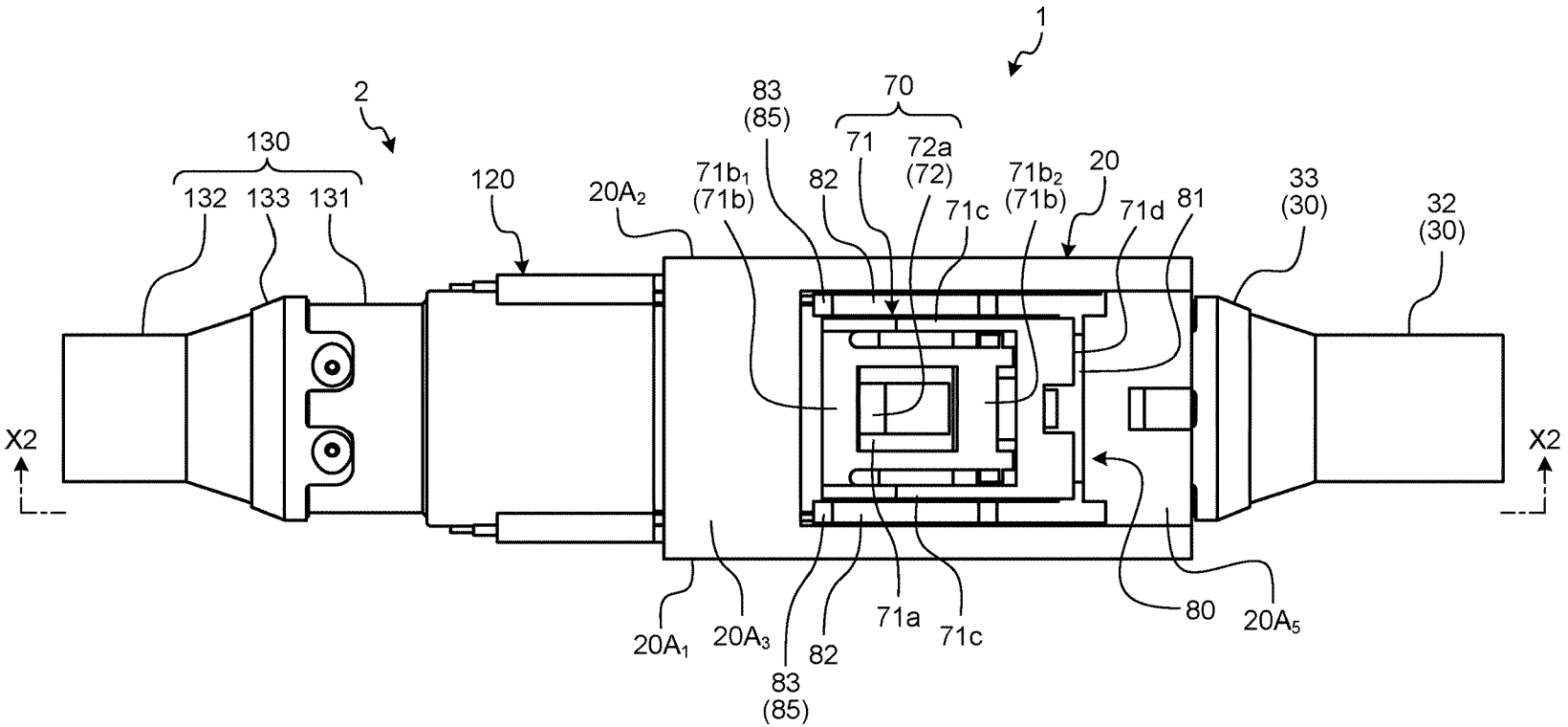
FIG. 3 is a plan view illustrating a state where the first and second connectors of the embodiment are completely fitted to each other and the detection member is located at the main locking position.
Figure 4:
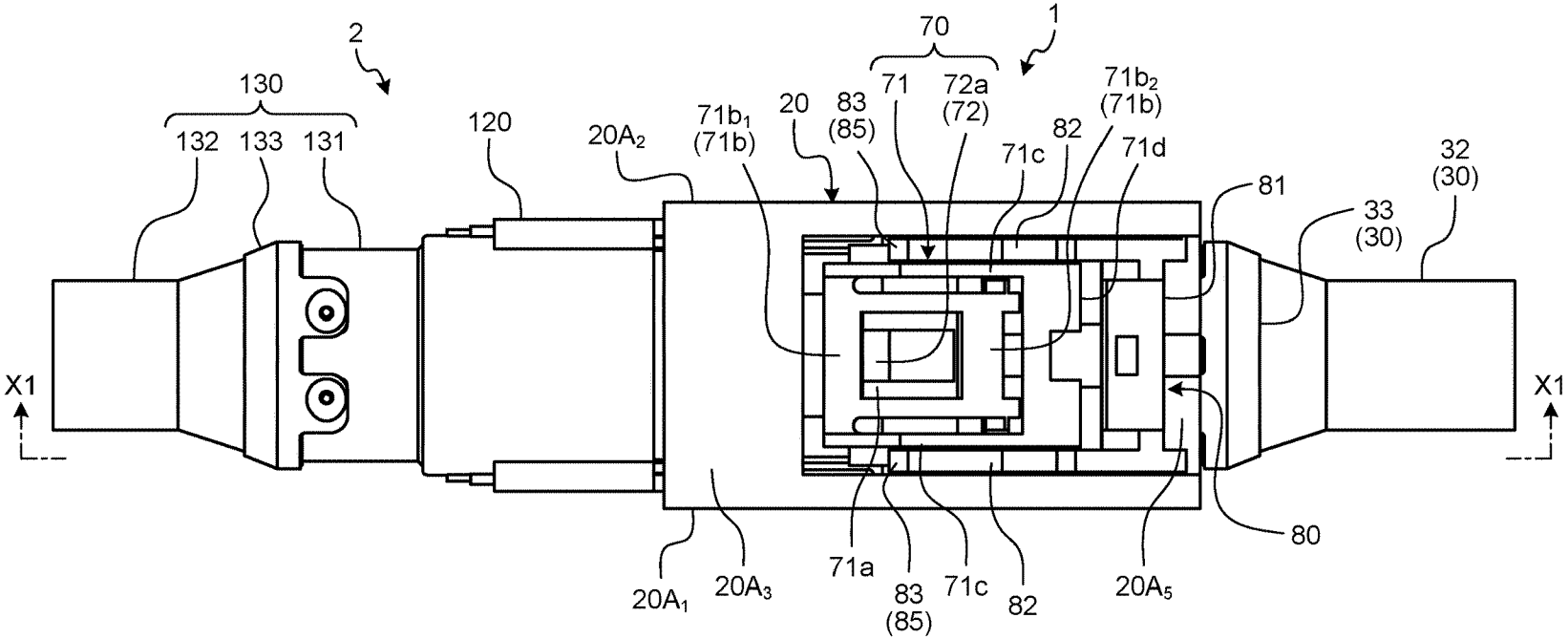
FIG. 4 is a plan view illustrating a state where the first and second connectors of the embodiment are completely fitted to each other and the detection member is located at the temporary locking position.
Figure 5:
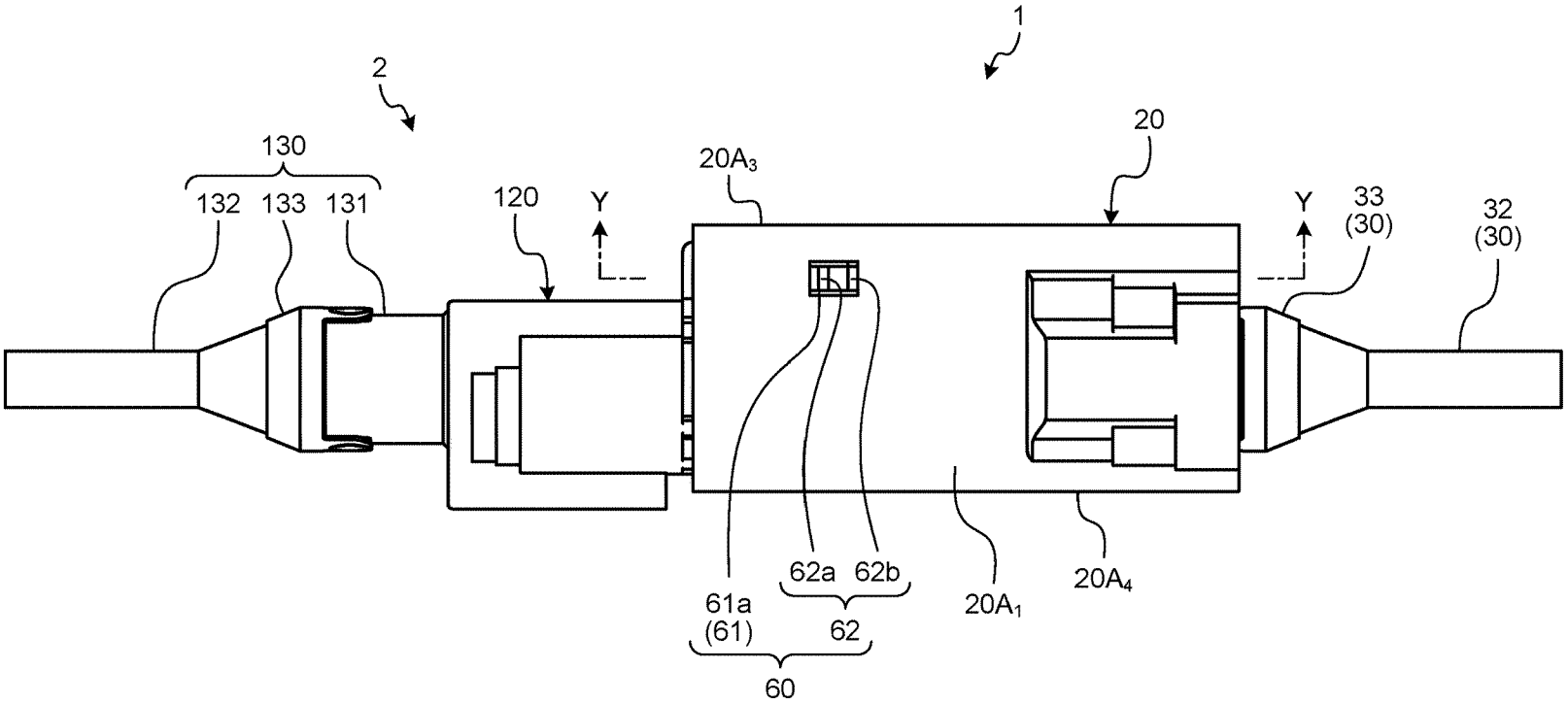
FIG. 5 is a side view illustrating a state where the first and second connectors of the embodiment are completely fitted to each other.

Further, the fitting connector is provided with a seal member 50 that improves the liquid-tightness at the fitted portion between the first connector 1 and the second connector 2 (FIGS. 7 and 8). In this example, the seal member 50 is provided at the first connector 1. Furthermore, the fitting connector is provided with first and second holding structures 60 and 70 which are provided between the first connector 1 and the second connector 2 to keep the fitted state between the female housing 20 and the male housing 120 (hereinafter, referred to as the "housings") in the completely fitted state (FIGS. 1 and 2). Furthermore, the fitting connector is provided with a detection member 80 that is a member for detecting the fitted state between the housings and determining the fitted state between the connectors based on the fitted state by an operator or the like (FIG. 7). In this example, the detection member 80 is provided at the first connector 1.

The female terminal 10 includes a terminal connection portion 11 which is physically and electrically connected to the male terminal 110 and a wire connection portion 12 which is physically and electrically connected to a wire W1 (FIG. 8). As in the female terminal 10, the male terminal 110 includes a terminal connection portion 111 which is physically and electrically connected to the female terminal 10 and a wire connection portion 112 which is physically and electrically connected to a wire W2 (FIG. 9). In this example, the terminal connection portion 111 of the male terminal 110 is formed in a tubular shape of which an axis direction matches the connector insertion and extraction direction and the terminal connection portion 11 of the female terminal 10 is formed in a tubular shape to match this shape. Further, the wire connection portions 12 and 112 are formed so that their wires W1 and W2 can be drawn out in the connector extraction direction. Core wires W1*a* and W2*a* of the terminals of the wires W1 and W2 are fixed to the wire connection portions 12 and 112 of this example by crimping such as caulking.

Each of the female housing 20 and the male housing 120 is molded in a predetermined shape by an insulating material such as a synthetic resin material. As will be described later, each of the female housing 20 and the male housing 120 of this example includes a tubular hood of which both ends are opened in the connector insertion and extraction direction. Each hood uses its inner space as a terminal accommodation room and is disposed to be integrated with a terminal holder in the inner space. When the female housing 20 and the male housing 120 are in the fitted state, the other hood is accommodated inside one hood so that the tubular axes of the hoods substantially match each other. That is, in the fitting connector, the tubular axis directions of the hoods of the female housing 20 and the male housing 120 become the connector insertion and extraction direction.

Specifically, the female housing 20 is formed as a two split structure including an outer housing 20A and an inner housing 20B (FIG. 7). The outer housing 20A and the inner housing 20B are fixed to each other by an engagement mechanism having a claw portion.

Figure 6:
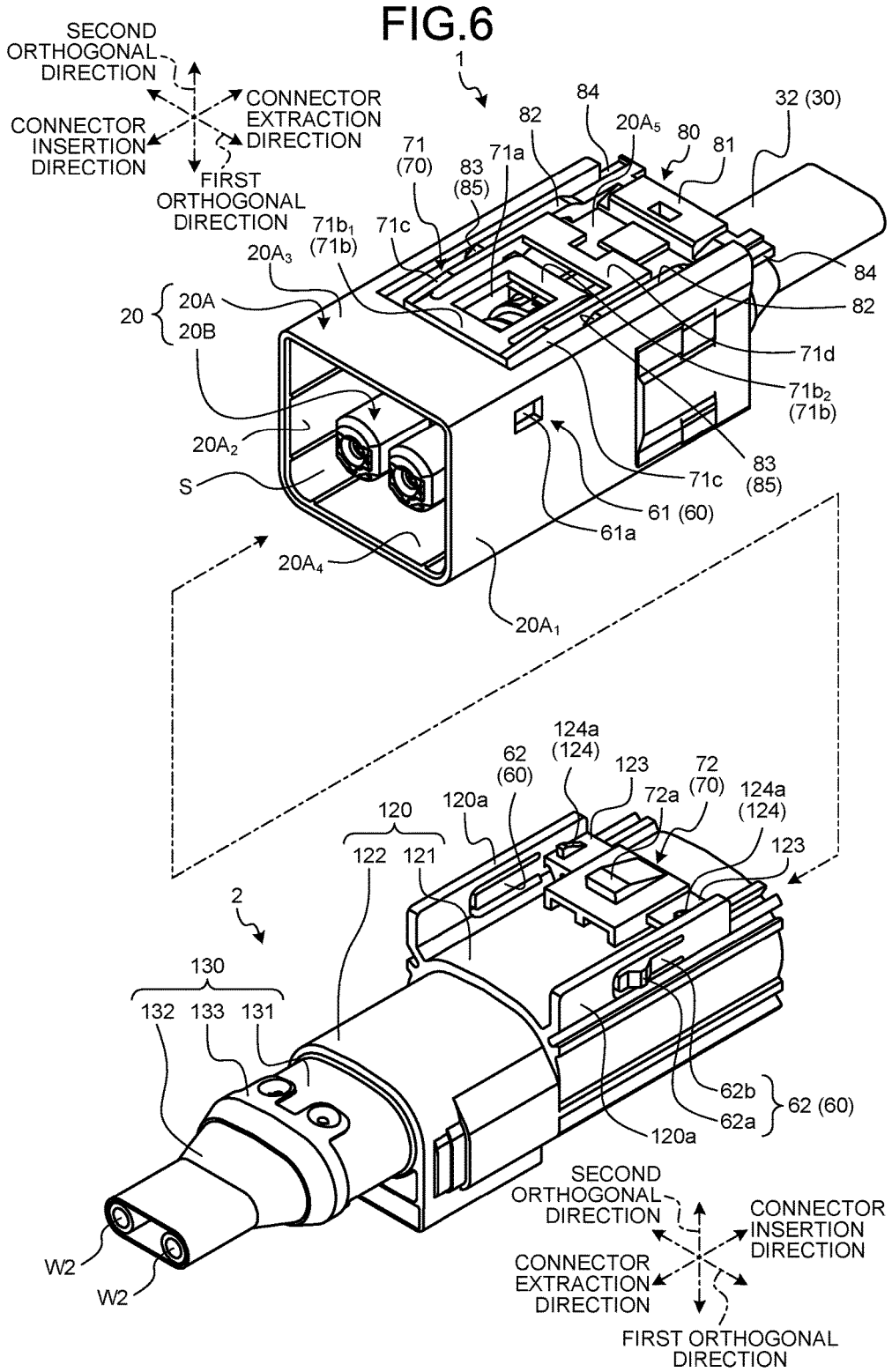
FIG. 6 is a perspective view illustrating a state before the first and second connectors of the embodiment are fitted to each other.

The outer housing 20A is used to form the above-described hood and is molded in a tubular shape of which both ends in the connector insertion and extraction direction are opened. In this example, the outer housing is molded in a square tubular shape which includes first and second wall bodies $\mathbf{20}A_1$ and $\mathbf{20}A_2$ which are formed in a substantially rectangular shape and face each other with a gap therebetween in the first orthogonal direction and third and fourth wall bodies $\mathbf{20}A_3$ and $\mathbf{20}A_4$ which are formed in a substantially rectangular shape and face each other with a gap therebetween in the second orthogonal direction (FIGS. 6 and 7). In the outer housing 20A, the inner housing 20B is accommodated and held in a square inner space surrounded by first to fourth wall bodies $\mathbf{20}A_1$, $\mathbf{20}A_2$, $\mathbf{20}A_3$, and $\mathbf{20}A_4$. Although it will be described later, the detection member 80 is attached to the outer housing 20A.

The inner housing 20B includes a terminal accommodation portion 21 which accommodates each of the female terminals 10 and a terminal holding portion 22 which is provided as the above-described terminal holder for each female terminal 10 (FIGS. 7 and 8). The terminal accommodation portion 21 is molded in a tubular shape of which a tubular axis direction matches the connector insertion and extraction direction so that both ends are opened and a terminal accommodation room (not illustrated) for each female terminal 10 is formed therein. Further, the terminal holding portion 22 is molded in a tubular shape of which a tubular axis direction matches the connector insertion and extraction direction so that both ends are opened and extends along the tubular axis direction from an opening of an end on the side of the connector insertion direction of the terminal accommodation portion 21. Two terminal holding portions 22 are arranged side by side for each female terminal 10. In this example, the terminal holding portions 22 are arranged in the first orthogonal direction. In each of the terminal holding portions 22, its inner space is formed as a terminal accommodation room (not illustrated) and each terminal accommodation room communicates with the terminal accommodation room of the terminal accommodation portion 21 through an opening of an end on the side of the connector extraction direction.

The female terminal 10 is inserted from an opening of an end on the side of the connector extraction direction of the terminal accommodation portion 21 along with the terminal of the wire W1 to be accommodated in the terminal accommodation room of the terminal accommodation portion 21 and the terminal accommodation room of the terminal holding portion 22. The terminal accommodation room of the terminal accommodation portion 21 accommodates the wire connection portion 12 of the female terminal 10 and the terminal of the wire W1 connected to the wire connection portion 12. Further, the terminal connection portion 11 of the female terminal 10 is accommodated and held in the terminal accommodation room of the terminal holding portion 22. A tubular lid member 23 of which both ends are opened is attached to an end on the side of the connector insertion direction of the terminal holding portion 22 (FIGS. 7 and 8).

The wire W1 is drawn outward from an opening of an end on the side of the connector extraction direction of the terminal accommodation portion 21. For this reason, the annular seal member 40 which is concentric with the wire W1 and through which the wire W1 is inserted is disposed in each of the terminal accommodation rooms of the terminal accommodation portions 21. The seal member 40 prevents the intrusion of a liquid (water or the like) into the terminal holding portion 22 from the wire W1 by bringing a coating W1*b* of the wire W1 into contact with its inner peripheral surface and bringing the inner peripheral surface of the terminal accommodation room of the terminal accommodation portion 21 into contact with its outer peripheral surface.

The shield structure 30 is used to prevent the intrusion of noise from the outside toward the terminal of the wire W1 and the female terminal 10 accommodated in the female housing 20. The shield structure 30 of this example includes a shield shell 31, a braid 32, and a connection member 33 (FIGS. 7 and 8).

The shield shell 31 is molded in a tubular shape by a conductive material such as metal and the inner housing 20B is integrally molded by insert-molding or the like. Since the shield shell 31 is integrated with the terminal accommodation portion 21 of the inner housing 20B, the shield shell is molded in a tubular shape of which a tubular axis direction matches the connector insertion and extraction direction so that both ends are opened in accordance with the shape of the terminal accommodation portion 21. In the shield shell 31 of this example, an outer peripheral surface of an end on the side of the connector insertion direction is exposed and the exposed surface is physically and electrically connected to a shield shell 131 of the second connector 2 after the fitting to the second connector 2. Further, in the shield shell 31 of this example, an outer peripheral surface of an end on the side of the connector extraction direction is exposed and the exposed surface is covered by an end on the side of the connector insertion direction of the braid 32. The braid 32 is knitted in a tubular shape and a net shape by a conductive material such as metal and covers the terminal of each wire W1 drawn outward. The connection member 33 is molded in a tubular shape and keeps the electrical connection state between the shield shell 31 and the braid 32 by pressing the braid 32 therein against the exposed surface of the end on the side of the connector extraction direction of the shield shell 31. The connection member 33 is connected to the shield shell 31 through the braid 32.

In the first connector 1 of this example, a tubular space S of which an end on the side of the connector insertion direction is opened is formed among the outer housing 20A, the inner housing 20B, and the shield shell 31 (FIG. 6). The second connector 2 is fitted to the first connector 1 while being inserted into the tubular space S from the opening. At that time, a portion on the side of the connector insertion direction of the second connector 2 is accommodated in the outer housing 20A. Then, the end on the side of the connector insertion direction of the terminal accommodation portion 21, the end on the side of the connector insertion direction of the shield shell 31, the terminal holding portion 22, and the lid member 23 are inserted into the male housing 120 on the side of the connector insertion direction of the second connector 2. The male terminal 110 is inserted into the terminal connection portion 11 through an opening of the terminal holding portion 22 and the lid member 23 in accordance with the insertion. For this reason, the seal member 50 is molded in an annular shape so that the end on the side of the connector insertion direction of the terminal accommodation portion 21 is inserted therethrough. Then, the seal member 50 brings its inner peripheral surface into contact with the end of the terminal accommodation portion 21 and brings its outer peripheral surface into contact with the inner peripheral surface of the male housing 120 inserted into the space S. In addition, the opening of the end on the side of the connector insertion direction of the terminal accommodation portion 21 is blocked except for a portion communicating with the terminal holding portion 22.

The male housing 120 includes a terminal accommodation portion 121 which accommodates each male terminal 110 and a terminal holding portion 122 which is provided for each male terminal 110 to serve as the above-described terminal holder (FIG. 9). The terminal accommodation portion 121 is molded in a tubular shape of which a tubular axis direction matches the connector insertion and extraction direction so that both ends are opened and a terminal accommodation room (not illustrated) for each male terminal 110 is formed therein. An end on the side of the connector insertion direction of the terminal accommodation portion 121 forms a front hood and is inserted into the tubular space S of the first connector 1. The outer peripheral surface of the seal member 50 comes into contact with the inner peripheral surface of the end. The terminal accommodation portion 121 of this example is molded in a tubular shape to match the shape of the outer peripheral surface of the shield shell 31 or the outer peripheral surface of the terminal accommodation portion 21 of the inner housing 20B. Further, the terminal holding portion 122 is molded in a tubular shape of which a tubular axis direction matches the connector insertion and extraction direction so that both ends are opened and a terminal accommodation room (not illustrated) for each male terminal 110 is formed therein. The terminal holding portion 122 is disposed at an opening of an end on the side of the connector extraction direction of the terminal accommodation portion 121. The terminal accommodation room of the terminal holding portion 122 communicates with the terminal accommodation room of the terminal accommodation portion 121 through an opening of an end on the side of the connector insertion direction.

The male terminal 110 is inserted from an opening of an end on the side of the connector extraction direction of the terminal holding portion 122 along with the terminal of the wire W2 to be accommodated in the terminal accommodation room of the terminal accommodation portion 121 and the terminal accommodation room of the terminal holding portion 122. The terminal accommodation room of the terminal accommodation portion 121 accommodates the terminal connection portion 111 of the male terminal 110. Further, the terminal accommodation room of the terminal holding portion 122 accommodates the wire connection portion 112 of the male terminal 110 and the terminal of the wire W2 connected to the wire connection portion 112. In the terminal accommodation room of the terminal holding portion 122, a holding target portion 113 (FIG. 9) of the male terminal 110 is fitted and held therein.

The wire W2 is drawn outward from the opening of the end on the side of the connector extraction direction of the terminal holding portion 122. For this reason, an annular seal member 140 which is concentric with the wire W2 and through which the wire W2 is inserted is disposed in each terminal accommodation room of the terminal holding portion 122. The seal member 140 prevents the intrusion of a liquid (water or the like) toward the inside of the terminal accommodation portion 121 from the wire W2 by bringing the coating W2*b* of the wire W2 into contact with its inner peripheral surface and bringing the inner peripheral surface of the terminal accommodation room of the terminal holding portion 122 into contact with its outer peripheral surface.

The shield structure 130 is used to prevent the intrusion of noise from the outside to the terminal of the wire W2 and the male terminal 110 accommodated in the male housing 120. The shield structure 130 of this example includes a shield shell 131, a braid 132, and a connection member 133 (FIG. 9).

The shield shell 131 is molded in a tubular shape by a conductive material such as metal and the male housing 120 is integrally molded by insert-molding or the like. The shield shell 131 is disposed to extend from the terminal accommodation portion 121 to the terminal holding portion 122 of the male housing 120 and is molded in a tubular shape of which a tubular axis direction matches the connector insertion and extraction direction so that both ends are opened. In the shield shell 131 of this example, an inner peripheral surface of an end on the side of the connector insertion direction is exposed and its exposed surface is physically and electrically connected to the shield shell 31 of the first connector 1 after the fitting to the first connector 1. Further, in the shield shell 131 of this example, an outer peripheral surface of an end on the side of the connector extraction direction is exposed and its exposed surface is covered by an end on the side of the connector insertion direction of the braid 132 which is the same as the braid 32 of the first connector 1. Similarly to the connection member 33 of the first connector 1, the connection member 133 is molded in a tubular shape and an electrical connection state between the shield shell 131 and the braid 132 is kept therein.

In the fitting connector, the first and second holding structures 60 and 70 are provided to regulate the relative movement at least between the housings in the connector extraction direction when the fitting operation between the female housing 20 and the male housing 120 is performed so that the fitted state becomes the completely fitted state.

The first holding structure 60 includes a first locking holder 61 which is provided in any one of the female housing 20 and the male housing 120 and a second locking holder 62 which is provided at the other thereof to engage with the first locking holder 61 in a locked state when the fitted state between the housings is in the completely fitted state (FIGS. 1, 2, 5, and 6). The first locking holder 61 includes a locking portion 61*a* which is formed by a hole portion or a groove portion. The first holding structure 60 of this example is formed as a slide locking structure in which the second locking holder 62 enters the locking portion 61*a* of the first locking holder 61 when the first locking holder 61 and the second locking holder 62 relatively move in accordance with the insertion between the housings so that the fitted state between the housings becomes the completely fitted state. For this reason, the second locking holder 62 is provided to regulate the relative movement in the connector extraction direction at least between the housings while entering the locking portion 61*a* of the first locking holder 61 when the fitted state between the housings is in the completely fitted state. For example, the second locking holder 62 includes a protrusion portion 62*a* which enters the locking portion 61*a* when the fitted state between the housings is in the completely fitted state. Further, the second locking holder 62 also includes a flexible portion 62*b* which has flexibility and can move the protrusion portion 62*a* in a direction opposite to the insertion direction toward the locking portion 61*a* of the first locking holder 61 while being bent.

In this example, the pair of the first locking holder 61 and the second locking holder 62 is provided as two sets. Further, in this example, the outer housing 20A of the female housing 20 is provided with the first locking holder 61 and the male housing 120 is provided with the second locking holder 62.

The first locking holders 61 of this example are respectively disposed at the first wall body 20$A_1$ and the second wall body 20$A_2$ to face each other in the first orthogonal direction. Here, a rectangular penetration hole is formed at each of the first wall body 20$A_1$ and the second wall body 20$A_2$ and an inner space formed by the penetration hole is used as the locking portion 61*a*.

Then, the second locking holder 62 of this example is disposed to match the position of each of the first locking holders 61 in the male housing 120 when the fitted state between the housings is in the completely fitted state. The second locking holder 62 is disposed in the space S of the first connector 1 in the completely fitted state and is inserted into the locking portion 61*a* from the space S. For this reason, if the second locking holder 62 is inserted into the locking portion 61*a* of the first wall body 20$A_1$, the protrusion portion 62*a* protrudes toward the inner wall surface of the first wall body 20$A_1$. If the second locking holder 62 is inserted into the locking portion 61*a* of the second wall body 20$A_2$, the protrusion portion 62*a* protrudes toward the inner wall surface of the second wall body 20$A_2$. Further, the flexible portion 62*b* of this example is formed in a cantilevered piece having flexibility and its free end is provided with the protrusion portion 62*a*. Here, the flexible portion 62*b* extends in the connector insertion and extraction direction, a portion on the side of the connector insertion direction of the second connector 2 is set as a fixed end, and a portion on the side of the connector extraction direction is set as a free end. Further, here, the second locking holder 62 is provided in a so-called beak protection wall 120*a* (a wall body for protecting a protrusion portion 72*a* (that is, a beak) of the second holding structure 70 to be described later in the completely fitted state) (FIG. 6).

In the first holding structure 60, in accordance with the insertion between the housings is performed, the inner wall surface of the first wall body 20$A_1$ bends the flexible portion 62*b* while moving on one protrusion portion 62*a* in a pressed state and the inner wall surface of the second wall body 20$A_2$ bends the flexible portion 62*b* while moving on the other protrusion portion 62*a* in a pressed state. Then, in the first holding structure 60, in a case where the fitted state between the housings is in the completely fitted state, the bending of the flexible portion 62*b* is released when one protrusion portion 62*a* is inserted into the locking portion 61*a* of the first wall body 20$A_1$ and the bending of the flexible portion 62*b* is released when the other protrusion portion 62*a* is inserted into the locking portion 61*a* of the second wall body 20$A_2$. Each protrusion portion 62*a* is locked to each wall surface on the side of the connector insertion and extraction direction of the entered locking portion 61*a*. Thus, since the first holding structure 60 can regulate the relative movement between the housings in the connector insertion and extraction direction, the fitted state between the housings can be kept in the completely fitted state.

The second holding structure 70 includes a first locking holder 71 which is provided at one of the female housing 20 and the male housing 120 and a second locking holder 72 which is provided at the other thereof to engage with the first locking holder 71 in a locked state when the fitted state between the housings is in the completely fitted state (FIGS. 1 to 4). The first locking holder 71 includes a locking portion 71*a* which is formed by a hole portion or a groove portion. The second holding structure 70 of this example is formed as a slide locking structure in which the second locking holder 72 enters the locking portion 71*a* of the first locking holder 71 when the first locking holder 71 and the second locking holder 72 relatively move in accordance with the insertion between the housings so that the fitted state between the housings becomes the completely fitted state. For this reason, the second locking holder 72 is provided to regulate the relative movement at least between the housings in the connector extraction direction while entering the locking portion 71*a* of the first locking holder 71 when the fitted state between the housings is in the completely fitted state. For example, the second locking holder 72 includes a protrusion portion 72*a* which enters the locking portion 71*a* when the fitted state between the housings is in the completely fitted state.

In this example, the pair of the first locking holder 71 and the second locking holder 72 is provided as one set. Further, in this example, the outer housing 20A of the female housing 20 is provided with the first locking holder 71 and the male housing 120 is provided with the second locking holder 72.

The first locking holder 71 of this example is disposed at the third wall body 20$A_3$. Here, a rectangular inner space of a rectangular annular body 71*b* is used as the locking portion 71*a*. The locking portion 71*a* is a penetration hole for the communication between the space S in the outer housing 20A and the outside. The first locking holder 71 includes arm portions 71*c* which are provided at both ends in the first orthogonal direction of a first edge 71$b_1$ on the side of the connector insertion direction of the rectangular annular body 71*b* to extend in the connector extraction direction from the both ends. Further, the first locking holder 71 includes a one-side portion 71*d* which connects the ends of the arm portions 71*c* in the extension direction. The outer housing 20A has a wall portion 20$A_5$ which is formed on the side of the space S in relation to the one-side portion 71*d* to face the one-side portion 71*d* in the second orthogonal direction with a gap therebetween. The first locking holder 71 can move the first edge 71$b_1$ in the second orthogonal direction by using a second edge 71$b_2$ on the side of the connector extraction direction of the rectangular annular body 71*b* as a fulcrum. Then, in the first locking holder 71, two arm portions 71*c* move in synchronization with the movement of the first edge 71$b_1$ and the one-side portion 71*d* can be moved toward the wall portion 20$A_5$.

Meanwhile, the second locking holder 72 of this example is disposed to match the position of the first locking holder 71 when the fitted state between the housings is in the completely fitted state in the male housing 120. The second locking holder 72 is disposed in the space S of the first connector 1 in the completely fitted state and is inserted into the locking portion 71*a* from the space S. For this reason, the second locking holder 72 allows the protrusion portion 72*a* to protrude toward the first locking holder 71 or the inner wall surface of the third wall body 20$A_3$.

In the second holding structure 70, the protrusion portion 72*a* comes into contact with the first edge 71$b_1$ of the first locking holder 71 in accordance with the insertion between the housings so that the first edge 71$b_1$ is pressed upward by the pressing force of the protrusion portion 72*a*. Then, in the second holding structure 70, the protrusion portion 72*a* is inserted into the locking portion 71*a* so that the first edge 71$b_1$ returns to an original position when the fitted state between the housings becomes the completely fitted state. Accordingly, the protrusion portion 72*a* is locked to the first edge 71$b_1$. Thus, since the second holding structure 70 can regulate the relative movement between the housings in the connector extraction direction, the fitted state between the housings can be kept in the completely fitted state.

As described above, the fitting connector is provided with the detection member 80 that detects the fitted state between the female housing 20 and the male housing 120 and determines the fitted state between the first connector 1 and the second connector 2 by the operator or the like based on the detected fitted state. The detection member 80 is well known in the technical field which is so-called fitting position assurance lock (CPA).

For example, the detection member 80 is attached to the outer housing 20A and determines the fitted state based on the relative position with respect to the outer housing 20A. Here, as the relative position, two locking positions where the detection member 80 can be locked to the outer housing 20A are set. As the two locking positions, a temporary locking position where the detection member 80 can be locked to the outer housing 20A regardless of the fitted state between the housings and a main locking position where the detection member 80 can be locked to the outer housing 20A only when the fitted state between the housings is in the completely fitted state are set. A first holding mechanism for holding the detection member 80 by the outer housing 20A at the temporary locking position and a second holding mechanism for holding the detection member 80 by the outer housing 20A at the main locking position are provided between the outer housing 20A and the detection member 80. The first and second holding mechanisms are well known in this technical field. For this reason, a detailed description of the first and second holding mechanisms will omitted herein.

The detection member 80 of this example is attached to the outer housing 20A so as to be relatively movable in the connector insertion and extraction direction. The detection member 80 can relatively move between the temporary locking position and the main locking position with respect to the outer housing 20A when the fitted state between the housings is in the completely fitted state. For this reason, the operator or the like can determine that the fitted state between the housings (the connectors) is in the completely fitted state when the detection member 80 can be relatively moved from the temporary locking position to the main locking position. Meanwhile, the detection member 80 cannot be relatively moved from the temporary locking position to the main locking position with respect to the outer housing 20A when the fitted state between the housings is in the half fitted state. For this reason, the operator or the like can determine that the fitted state between the housings (the connectors) is in the half fitted state based on a state where the detection member 80 cannot reach the main locking position. In the fitting connector, the outer housing 20A, the male housing 120, and the detection member 80 are formed so that the detection member 80 can be operated with respect to the outer housing 20A.

For example, the detection member 80 of this example includes an operation portion 81 which is used by the operator or the like during the relative movement, two arm portions 82 which extend toward the same direction from both ends of the operation portion 81, and a guiding target portion 83 which is provided at an end on the side of the extension direction of each arm portion 82 (FIG. 7).

The operation portion 81 of this example is formed to enter a gap between the wall portion 20$A_5$ of the outer housing 20A and the one-side portion 71*d* of the first locking holder 71. Specifically, the operation portion 81 is formed not to enter the gap at the temporary locking position, but to enter the gap at the main locking position.

The arm portions 82 are provided at both ends of the operation portion 81 in the first orthogonal direction to extend toward the connector insertion direction while being attached to the outer housing 20A. Further, the arm portions 82 are formed to sandwich the arm portions 71*c* of the first locking holders 71 while being attached to the outer housing 20A and are respectively moved relatively in the connector insertion and extraction direction along the arm portions 71*c*. Further, each arm portions 82 is formed to be sandwiched between the beak protection wall 120*a* of the male housing 120 and the arm portion 71*c* at the main locking position.

Figure 10:
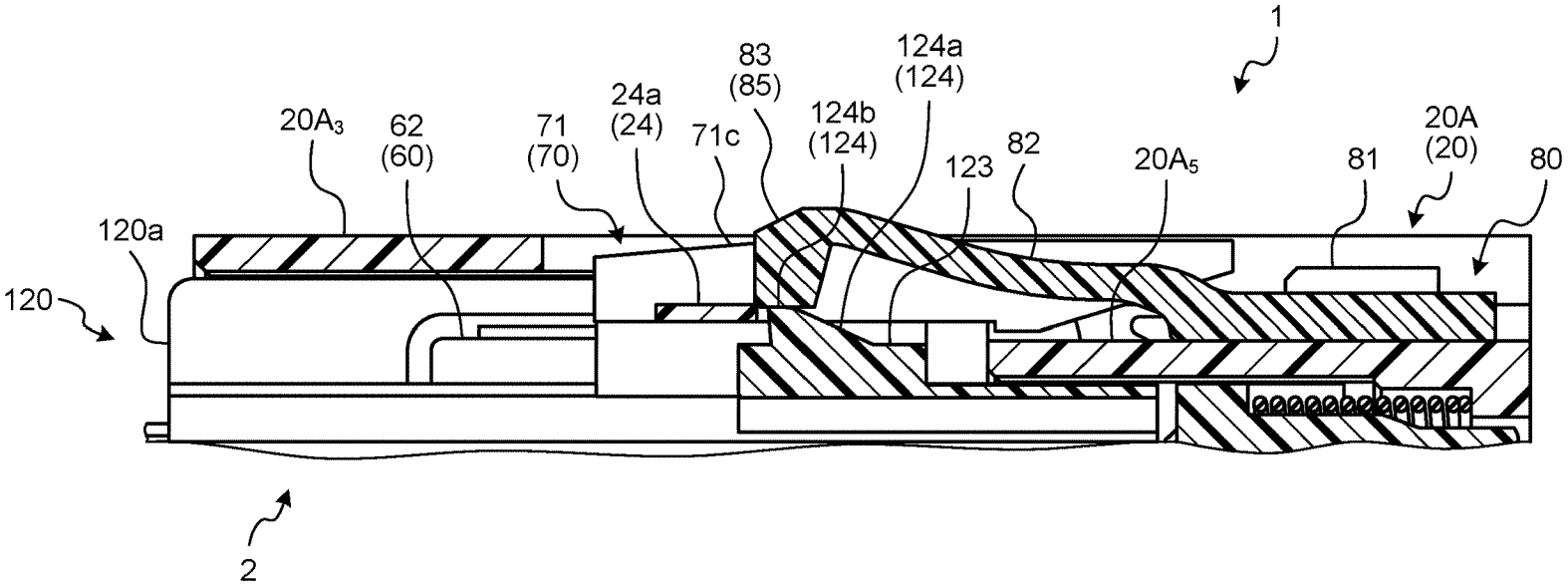
FIG. 10 is a cross-sectional view taken along a line X1-X1 of FIG. 4 and is a diagram obtained by extracting the periphery of a first holding structure.

The guiding target portion 83 protrudes toward the space S in the second orthogonal direction from an end on the side of the extension direction of the arm portion 82. When the detection member 80 is located at the temporary locking position, a sliding portion 123 (FIG. 6) provided in the male housing 120 comes into contact with the guiding target portion 83 while the fitted state between the housings changes from the half fitted state to the completely fitted state. The sliding portion 123 is provided for each guiding target portion 83. The sliding portion 123 is provided with a protrusion body 124 which comes into contact with the guiding target portion 83 during a change in the fitted state between the housings and slides the guiding target portion 83 in accordance with the change. The protrusion body 124 includes an inclined surface (that is, a guide surface) 124*a* which guides the guiding target portion 83 in a sliding state in accordance with a change in the fitted state between the housings. The inclined surface 124*a* lifts the guiding target portion 83 while bending the arm portion 82 with respect to the operation portion 81. The guiding target portion 83 gets on a top surface 124*b* of the protrusion body 124 over the inclined surface 124*a* when the fitted state between the housings becomes the completely fitted state (FIG. 10). In this series of movements, the holding position of the detection member 80 with respect to the outer housing 20A is kept by a first holding mechanism (not illustrated).

In this example, since the guiding target portion 83 gets on the top surface 124*b* of the protrusion body 124, the detection member 80 can be relatively moved from the temporary locking position to the main locking position with respect to the outer housing 20A. That is, since the guiding target portion 83 cannot get on the top surface 124*b* of the protrusion body 124 when the fitted state between the housings is in the half fitted state, the detection member 80 cannot be relatively moved toward the main locking position. For this reason, the operator or the like can recognize a state where the position of the detection member 80 with respect to the outer housing 20A is stopped in the half fitted state.

Figure 11:
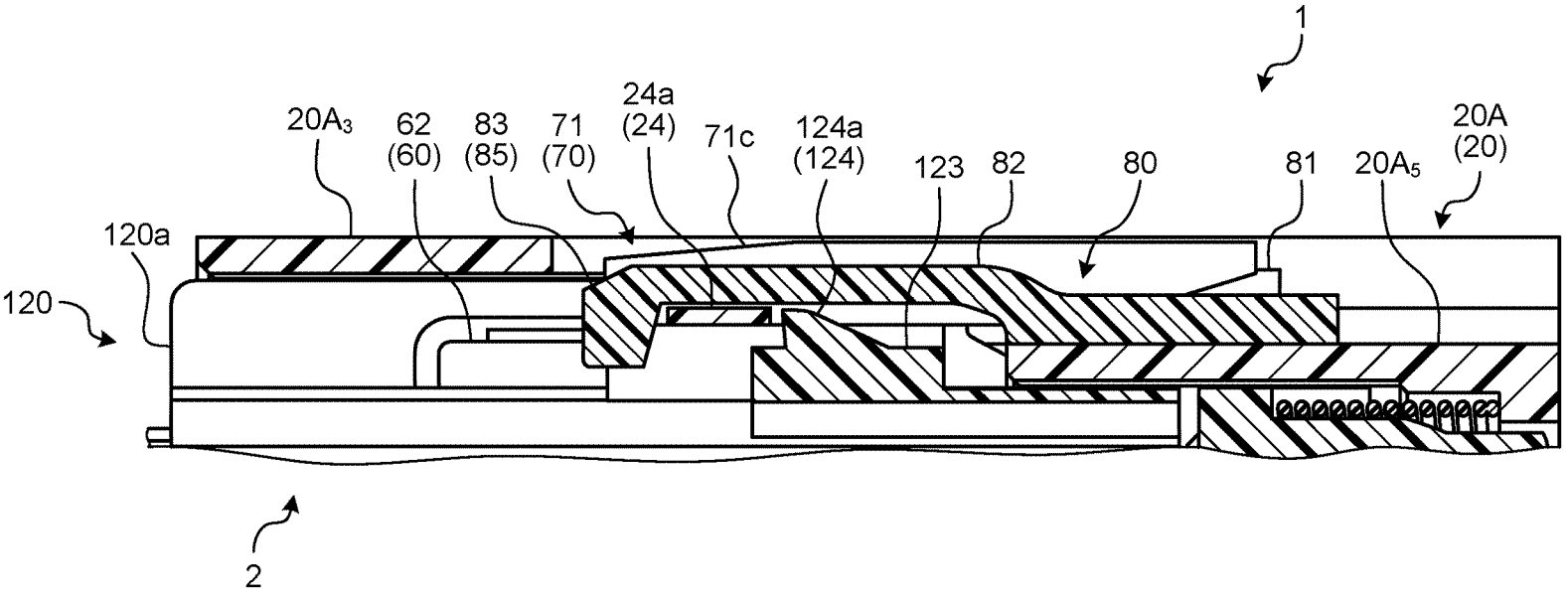
FIG. 11 is a cross-sectional view taken along a line X2-X2 of FIG. 3 and is a diagram obtained by extracting the periphery of the first holding structure.
Figure 12:
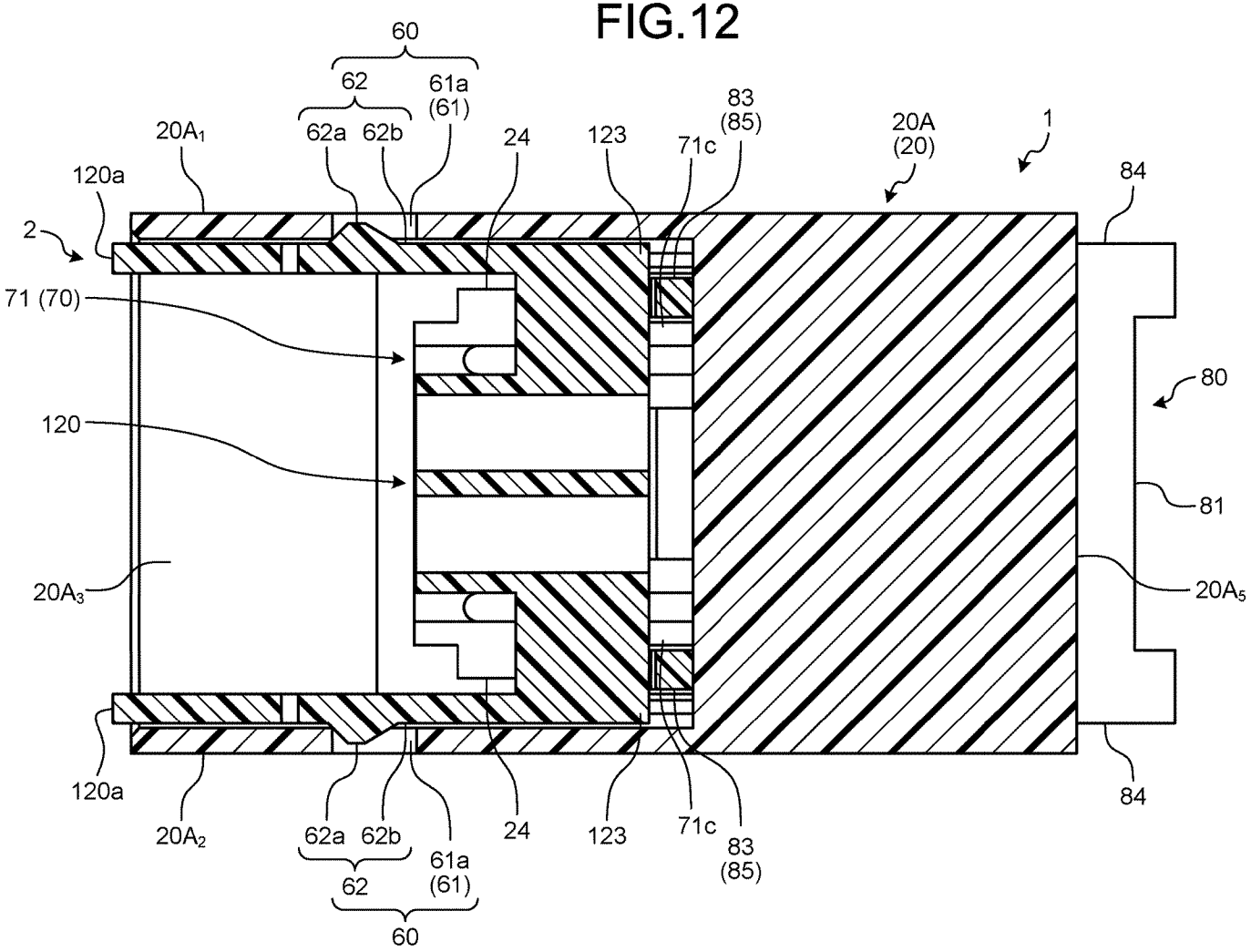
FIG. 12 is a cross-sectional view taken along a line Y-Y of FIG. 5 and is a diagram illustrating a state where the detection member is located at the temporary locking position.
Figure 13:
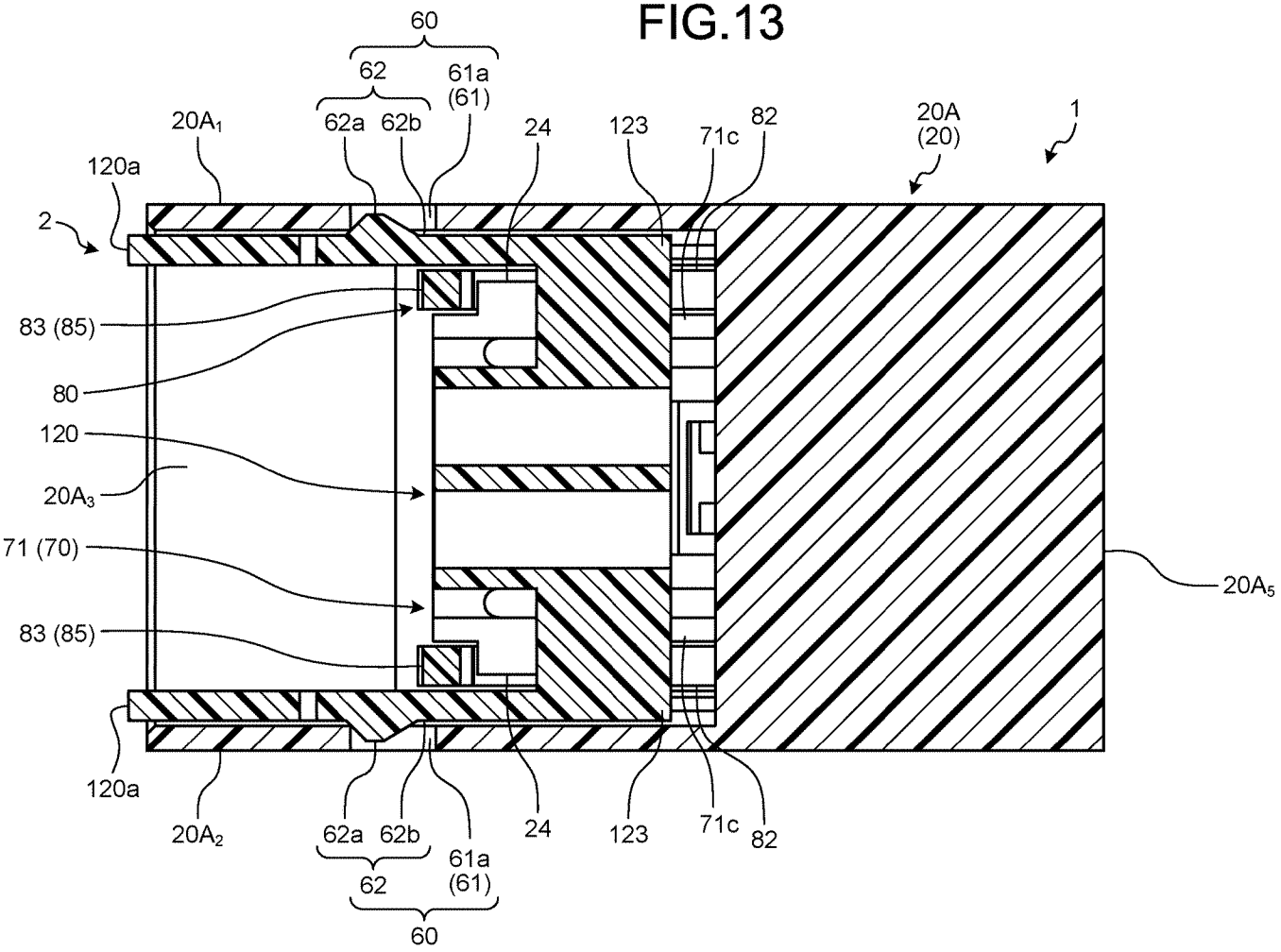
FIG. 13 is a cross-sectional view taken along a line Y-Y of FIG. 5 and is a diagram illustrating a state where the detection member is located at the main locking position.

The detection member 80 is relatively moved with respect to the outer housing 20A from the temporary locking position to the main locking position in such a manner that the operator or the like presses and moves the operation portion 81. The detection member 80 locks the guiding target portion 83 to the outer housing 20A at the main locking position to regulate the relative movement in the connector extraction direction. For this reason, the outer housing 20A is provided with a locking portion 24 (FIGS. 10 and 11). The locking portion 24 is provided at each of the arm portions 71*c* of the first locking holder 71. Each locking portion 24 is disposed to be located at a position closer to the connector insertion direction in relation to the protrusion body 124 when the fitted state between the housings is in the completely fitted state. The guiding target portion 83 is locked to an end surface on the side of the connector insertion direction of the locking portion 24 at the main locking position to regulate the relative movement of the detection member 80 toward the connector extraction direction.

The locking portion 24 is formed in a piece shape and is disposed so that a plane opposite to the space S follows the connector insertion and extraction direction. The plane is used as the guide surface 24*a* which guides the guiding target portion 83 in a sliding manner at the time of relatively moving the detection member 80. The guide surface 24*a* is disposed so as to be substantially flush with the top surface 124*b* on the side of the protruding direction of the protrusion body 124 in the connector insertion and extraction direction when the fitting state between the housings is in the completely fitted state. For this reason, the locking portion 24 and the protrusion body 124 come into contact with each other during the fitting operation between the housings. However, since the locking portion 24 can be pressed and moved along with the arm portion 71*c* and the rectangular annular body 71*b* by the pressing force of the inclined surface 124*a* of the protrusion body 124, it is possible to get over the protrusion body 124 when the fitted state between the housings is in the completely fitted state. Along with the getting over, the locking portion 24 returns to an original position along with the arm portion 71*c* and the rectangular annular body 71*b* and the guide surface 24*a* becomes substantially flush with the top surface 124*b* of the protrusion body 124. For this reason, since the detection member 80 can transfer the guiding target portion 83 getting on the top surface 124*b* of the protrusion body 124 on the guide surface 24*a* of the locking portion 24, the relative movement from the temporary locking position to the main locking position becomes possible. The guiding target portion 83 which is transferred to the guide surface 24*a* gets on the locking portion 24 while moving toward the main locking position along the guide surface 24*a*. Accordingly, the detection member 80 can lock the guiding target portion 83 to the end surface on the side of the connector insertion direction of the locking portion 24. Thus, the completely fitted state can be recognized by the operator or the like who recognizes the position of the detection member 80 in the completely fitted state.

In addition, when the first edge 71$b_1$ is lifted to release the locked state of the second holding structure 70 at the time of extracting the connector, the arm portion 82 of the detection member 80 can be also lifted along with the locking portion 24. For this reason, in the fitting connector, the first connector 1 and the second connector 2 can be extracted from each other.

Further, another guiding target portion 84 is provided at each arm portion 82 of the detection member 80 (FIG. 7) and the relative movement with respect to the outer housing 20A is guided by each guiding target portion 84. The outer housing 20A is provided with a guide portion 25 which guides the guiding target portion 84 in the connector insertion and extraction direction. Here, the guiding target portion 84 is formed in a piece shape and the guide portion 25 is formed in a groove shape. Further, here, an allowance (a gap) in the second orthogonal direction is provided between the guiding target portion 84 and the guide portion 25 in order to allow the inclination of the detection member 80 with respect to the outer housing 20A as the operation portion 81 is pressed downward.

As described above, since the fitting connector of the embodiment keeps the completely fitted state between the housings by two holding structures of the first holding structure 60 and the second holding structure 70, it is possible to increase the holding force for keeping the completely fitted state.

Further, in the fitting connector, since the locking holders (the first locking holder 61, the second locking holder 62, the first locking holder 71, and the second locking holder 72) of the first holding structure 60 and the second holding structure 70 are provided as a part of the female housing 20 or a part of the male housing 120, it is possible to increase the holding force without increasing the number of components.

Further, the fitting connector is provided with the first holding structure 60 along with the second holding structure 70 having the same configuration as the related art, but when the second locking holder 62 of the first holding structure 60 is provided in the beak protection wall 120*a*, it is possible to increase the holding force without increasing the size compared to the related art.

Furthermore, the fitting connector can reduce each of the connector insertion and extraction force generated by the first holding structure 60 and the connector insertion and extraction force generated by the second holding structure 70 by distributing the holding force (the necessary holding force) to be needed to the first holding structure 60 and the second holding structure 70. Here, the connector insertion and extraction force generated by the first holding structure 60 corresponds to, for example, a pressing force of one protrusion portion 62*a* with respect to the inner wall surface of the first wall body 20$A_1$ generated by the flexible portion 62*b* (that is, a friction force generated when one protrusion portion 62*a* slides on the inner wall surface of the first wall body 20$A_1$), a pressing force of the other protrusion portion 62*a* with respect to the inner wall surface of the second wall body 20$A_2$ generated by the flexible portion 62*b* (that is, a friction force generated when the other protrusion portion 62*a* slides on the inner wall surface of the second wall body 20$A_2$), and the like. Further, the connector insertion and extraction force generated by the second holding structure 70 corresponds to a force generated when the protrusion portion 72*a* presses the first edge 71*b*$_1$ upward (that is, a friction force generated when the protrusion portion 72*a* slides on the first edge 71*b*$_1$) and the like. Such a force increases as the holding force for keeping the completely fitted state increases. For this reason, since the fitting connector can reduce an insertion force at the time of fitting the connector between the first connector 1 and the second connector 2 or an extraction force at the time of extracting the connector compared to the case of securing the necessary holding force only by one holding structure, it is possible to prevent degradation in workability at the time of inserting and extracting the connector.

Furthermore, in the fitting connector, since a slide locking structure is used for the first holding structure 60 and the second holding structure 70, it is possible to prevent degradation in workability at the time of inserting and extracting the connector.

In this way, the fitting connector of the embodiment can increase the holding force for keeping the completely fitted state while preventing degradation in workability at the time of inserting and extracting the connector. The fitting connector has a configuration of preventing the unintentional releasing of the locked state of the holding structure in order to keep the increased holding force. For example, in the fitting connector of the embodiment, the second holding structure 70 is formed so as to generate the same holding force as the conventional holding structure with only one holding structure and the deficiency of the necessary holding force is made up by the first holding structure 60. Then, in the fitting connector, since the size of the protrusion portion 62*a* of the first holding structure 60 is smaller than the size of the protrusion portion 72*a* of the second holding structure 70, the holding force generated by the first holding structure 60 is smaller than the holding force generated by the second holding structure 70. For this reason, in the fitting connector, the locked state between the first locking holder 61 and the second locking holder 62 of the first holding structure 60 is kept to prevent degradation in increased holding force.

In the fitting connector of the embodiment, the locked state of the first holding structure 60 is kept by using the detection member 80. For this reason, the detection member 80 is provided with a bending locking portion 85 for locking the bending of the flexible portion 62*b* of the second locking holder 62 within the range in which the protrusion portion 62*a* of the second locking holder 62 does not come out from the locking portion 61*a* of the first locking holder 61 at the main locking position (see FIGS. 1 to 4). As the bending locking portion 85, the arm portion 82 or the guiding target portion 83 can be used. In this example, the guiding target portion 83 may be used as the bending locking portion 85.

When the detection member 80 of this example is located at the main locking position, each of the arm portion 82 and the guiding target portion 83 is sandwiched between the arm portion 71*c* of the first locking holder 71 and the beak protection wall 120*a* of the male housing 120 and the arm portion 82 and the guiding target portion 83 respectively face the beak protection wall 120*a* in the second orthogonal direction. For this reason, in the first holding structure 60, the second locking holder 62 is provided in the beak protection wall 120*a* so that the second locking holder 62 faces the guiding target portion 83 in the second orthogonal direction at the main locking position and the second locking holder 62 does not face the guiding target portion 83 in the second orthogonal direction at the temporary locking position and the locking portion 61*a* of the first locking holder 61 is provided to match the protrusion portion 62*a* of the second locking holder 62 at that position. Then, a gap between the second locking holder 62 and the guiding target portion 83 in the second orthogonal direction is set so that the bending of the flexible portion 62*b* is locked by the guiding target portion 83 within a range in which the protrusion portion 62*a* does not come out from the locking portion 61*a* even when the flexible portion 62*b* is bent in a direction in which the protrusion portion 62*a* comes out from the locking portion 61*a* at the main locking position (that is, a direction toward the arm portion 82).

When the fitting connector includes the first holding structure 60 and the detection member 80 with such a configuration, the guiding target portion 83 (the bending locking portion 85) does not lock the bending of the flexible portion 62*b* (FIG. 12) when the detection member 80 is at the temporary locking position. Then, the protrusion portion 62*a* can be inserted into the locking portion 61*a* at the time of fitting the connectors and the protrusion portion 62*a* can be extracted from the locking portion 61*a* at the time of extracting the connector. For this reason, when the detection member 80 is located at the temporary locking position, the first connector 1 and the second connector 2 can be inserted and extracted. That is, the temporary locking position herein indicates a retracted position of the detection member 80 where the connectors can be inserted and extracted and the bending of the flexible portion 62*b* is not locked. On the contrary, since the guiding target portion 83 (the bending locking portion 85) and the protrusion portion 62*a* do not come out from the locking portion 61*a* (FIG. 13) when the detection member 80 is located at the main locking position, the locked state of the first holding structure 60 can be kept. Thus, the fitting connector can increase the holding force for keeping the completely fitted state and keep the holding force while preventing degradation in workability at the time of inserting and extracting the connector. Then, in the fitting connector, since the locked state of the first holding structure 60 is kept by the detection member 80, it is possible to keep the increased holding force without increasing the number of components or the size thereof. Further, when the fitting connector is mounted on a vehicle or the like, there is an external input in accordance with the vibration in the travel state, but since the holding force for keeping the completely fitted state can be kept, the vibration resistance is also improved.

Since a fitting connector according to the embodiment keeps the completely fitted state between the housings by two holding structures including the first holding structure and the second holding structure, it is possible to increase the holding force for keeping the completely fitted state. Further, since the fitting connector can reduce a force generated by the first holding structure at the time of inserting and extracting the connector and a force generated by the second holding structure at the time of inserting and extracting the connector by distributing the necessary holding force to the first holding structure and the second holding structure, it is possible to reduce the insertion force at the time of fitting the connector or the extraction force at the time of extracting the connector between the female connector and the male connector and thus to prevent degradation in workability at the time of inserting and extracting the connector. Furthermore, in the fitting connector, since the protrusion portion does not come out of the locking portion by the bending locking portion when the detection member is located at the main locking position, it is possible to keep the locked state of the first holding structure. In this way, the fitting connector according to the embodiment can increase the holding force for keeping the completely fitted state and can keep the holding force while preventing degradation in workability at the time of inserting and extracting the connector.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fitting connector comprising:

a first connector that includes a terminal and a housing holding the terminal;

a second connector that includes a counterpart terminal and a counterpart housing holding the counterpart terminal, the counterpart terminal being electrically connected to the terminal when a mutual fitted state in accordance with an insertion between the counterpart housing and the housing is in a completely fitted state;

a detection member that is a member for detecting the fitted state, is relatively movable to a main locking position with respect to the housing when the fitted state is in the completely fitted state, and is locked to the housing at the main locking position; and a first holding structure and a second holding structure that keep the fitted state in the completely fitted state, wherein the first holding structure includes a first locking holder that is provided in the housing and includes a locking portion formed by a hole portion or a groove portion and a second locking holder that is provided in the counterpart housing and enters the locking portion of the first locking holder when the fitted state is in the completely fitted state to regulate a relative movement between the housing and the counterpart housing in a connector extraction direction, the second locking holder includes a protrusion portion that enters the locking portion of the first locking holder and a flexible portion that has flexibility and is capable of moving the protrusion portion in a direction opposite to a direction in which the first locking holder is inserted into the locking portion while the flexible portion being bent, and the detection member includes a bending locking portion that locks the bending of the flexible portion within a range in which the protrusion portion does not come out from the locking portion of the first locking holder at the main locking position.

2. The fitting connector according to claim 1, wherein the first holding structure is a slide locking structure in which the first locking holder and the second locking holder relatively move in accordance with the insertion between the housing and the counterpart housing and the protrusion portion of the second locking holder enters the locking portion of the first locking holder when the fitted state becomes the completely fitted state.

3. The fitting connector according to claim 1, wherein the detection member is attached to the housing to be relatively movable with respect to the housing from a retracted position in which the bending of the flexible portion is not locked to the main locking position.

4. The fitting connector according to claim 2, wherein the detection member is attached to the housing to be relatively movable with respect to the housing from a retracted position in which the bending of the flexible portion is not locked to the main locking position.

* * * * *